US007673543B2

(12) United States Patent
Albonetti

(10) Patent No.: US 7,673,543 B2
(45) Date of Patent: Mar. 9, 2010

(54) APPARATUS FOR MAKING A FRACTURE CUT BETWEEN THE CUP AND THE SAFETY RING IN PLASTIC CAPS

(75) Inventor: Danilo Albonetti, Sasso Morelli (IT)

(73) Assignee: Sacmi Cooperativa Meccanici Imola S.C.R.L., Imola (IT)

( * ) Notice: Subject to any disclaimer, the term of this patent is extended or adjusted under 35 U.S.C. 154(b) by 1223 days.

(21) Appl. No.: 10/519,233

(22) PCT Filed: Jun. 30, 2003

(86) PCT No.: PCT/IB03/03053

§ 371 (c)(1),
(2), (4) Date: Dec. 27, 2004

(87) PCT Pub. No.: WO2004/004993

PCT Pub. Date: Jan. 15, 2004

(65) Prior Publication Data

US 2005/0223867 A1 Oct. 13, 2005

(30) Foreign Application Priority Data

Jul. 2, 2002 (IT) ..... BO2002A0422

(51) Int. Cl.
*B26D 7/06* (2006.01)
*B26D 7/32* (2006.01)
*B26F 1/00* (2006.01)
*B65D 41/34* (2006.01)

(52) U.S. Cl. ..... 82/101; 82/46; 83/158; 83/879; 83/946; 413/10; 413/67; 425/809

(58) Field of Classification Search ..... 83/879, 83/54, 109, 158, 161, 733, 880–882, 946; 53/296–298; 82/1.11, 46, 47, 101; 264/154, 264/163, 268; 413/10, 67; 425/289–291, 425/305.1, 809
See application file for complete search history.

(56) References Cited

U.S. PATENT DOCUMENTS

| | | | | | |
|---|---|---|---|---|---|
| 2,516,908 | A | * | 8/1950 | Pottle | 118/50 |
| 2,851,727 | A | * | 9/1958 | Wilckens et al. | 425/110 |
| 3,074,138 | A | * | 1/1963 | Elliott | 425/216 |
| 4,744,480 | A | | 5/1988 | Luch et al. | 215/252 |

(Continued)

FOREIGN PATENT DOCUMENTS

| | | |
|---|---|---|
| EP | A- 0 533 633 | 3/1993 |

(Continued)

*Primary Examiner*—Clark F. Dexter
(74) *Attorney, Agent, or Firm*—Modiano & Associati; Albert Josif; Daniel J. O'Byrne

(57) ABSTRACT

An apparatus for making a fracture cut between the cup and the safety ring in plastic caps, which comprises rotary elements provided with at least one mandrel that can be arranged inside the cup and is suitable to produce the rolling, about its own axis of symmetry, of the side wall of the cup along the cutting edge of a blade for making the cut, the blade being associated with an inlet path portion adapted to axially offset the cup with respect to the rotation axis of the mandrel by clamping the side wall against the mandrel; the apparatus also comprises elements for recentering the cup with respect to the rotation axis.

10 Claims, 3 Drawing Sheets

U.S. PATENT DOCUMENTS

| | | | | | |
|---|---|---|---|---|---|
| 5,372,672 | A * | 12/1994 | Seifert et al. | 156/584 |
| 5,488,888 | A * | 2/1996 | Kowal | 83/880 |
| 5,564,319 | A * | 10/1996 | Kowal | 82/46 |
| 7,059,232 | B2 * | 6/2006 | Kowal | 83/880 |

FOREIGN PATENT DOCUMENTS

| | | |
|---|---|---|
| EP | A- 1 243 520 | 9/2002 |
| WO | A- 96 11856 | 4/1996 |

* cited by examiner

APPARATUS FOR MAKING A FRACTURE CUT BETWEEN THE CUP AND THE SAFETY RING IN PLASTIC CAPS

The present invention relates to an apparatus for making a fracture cut between the cup and the safety ring in plastic caps.

BACKGROUND OF THE INVENTION

Apparatuses are known which produce, on the side wall of plastic caps, a circumferential fracture cut that forms the safety ring that remains attached to the container after tearing the cup from the cap: for this purpose, inside the cup there are retention elements, obtained for example by folding inward the end flap of the ring, which are suitable to engage on the protruding collar provided on the neck of the container.

In these apparatuses, the fracture cut is generally provided by rolling the lateral surface of the cap along a blade whose cutting edge is perpendicular to the axis of said cap by means of a mandrel that engages within the cup. In performing said cap rolling step, the mandrel is substantially axially offset with respect to the cup, since the blade is associated with an inlet portion that is suitable to move said cup with respect to the axis of the mandrel: in rolling the cap, the side wall of the cup is therefore kept pressed by the mandrel against the cutting edge of the blade, thus providing the cut.

At the end of the cap rolling step it is necessary to reposition the cup in axial alignment with respect to the mandrel, so as to be able to proceed correctly with the subsequent operations of the production process: for example, the cup must be removable from the mandrel without encountering the obstacle constituted by the undercuts formed by the presence of the retention elements within said cup.

Repositioning the cup, moreover, is a rather complicated operation in view of the many shapes and dimensions that characterize commercially available caps.

SUMMARY OF THE INVENTION

The technical aim of the present invention is to provide an apparatus for making a fracture cut between the cup and the safety ring in plastic caps that allows, after forming said cut, to reposition the cup in axial alignment with respect to the mandrel inserted therein.

Within the scope of this technical aim, an object of the present invention is to provide an apparatus that is versatile and adaptable to caps of various shapes and dimensions.

Another object of the present invention is to achieve said aim with a structure that is simple, relatively easy to provide in practice, safe in use, effective in operation, and relatively low in cost.

This aim and these objects are all achieved by the present apparatus for making a fracture cut between the cup and the safety ring in plastic caps, which comprises rotary means provided with at least one mandrel that can be arranged inside said cup and is adapted to produce the rolling, about its own axis of symmetry, of the side wall of said cup along the cutting edge of a blade for making said cut, said blade being associated with an inlet path portion adapted to axially offset said cup with respect to the rotation axis of said mandrel by clamping said side wall against said mandrel, characterized in that it comprises means for recentering said cup with respect to said rotation axis.

Advantageously, said rotary means are driven by a motor by way of belt drive elements.

BRIEF DESCRIPTION OF THE DRAWINGS

Further particularities will become better apparent and evident from the detailed description of a preferred but not exclusive embodiment of an apparatus for making a fracture cut between the cup and the sealing ring in plastic caps according to the invention, illustrated by way of non-limitative example in the accompanying drawings, wherein.

DESCRIPTION OF THE PREFERRED EMBODIMENTS

Figure 1:
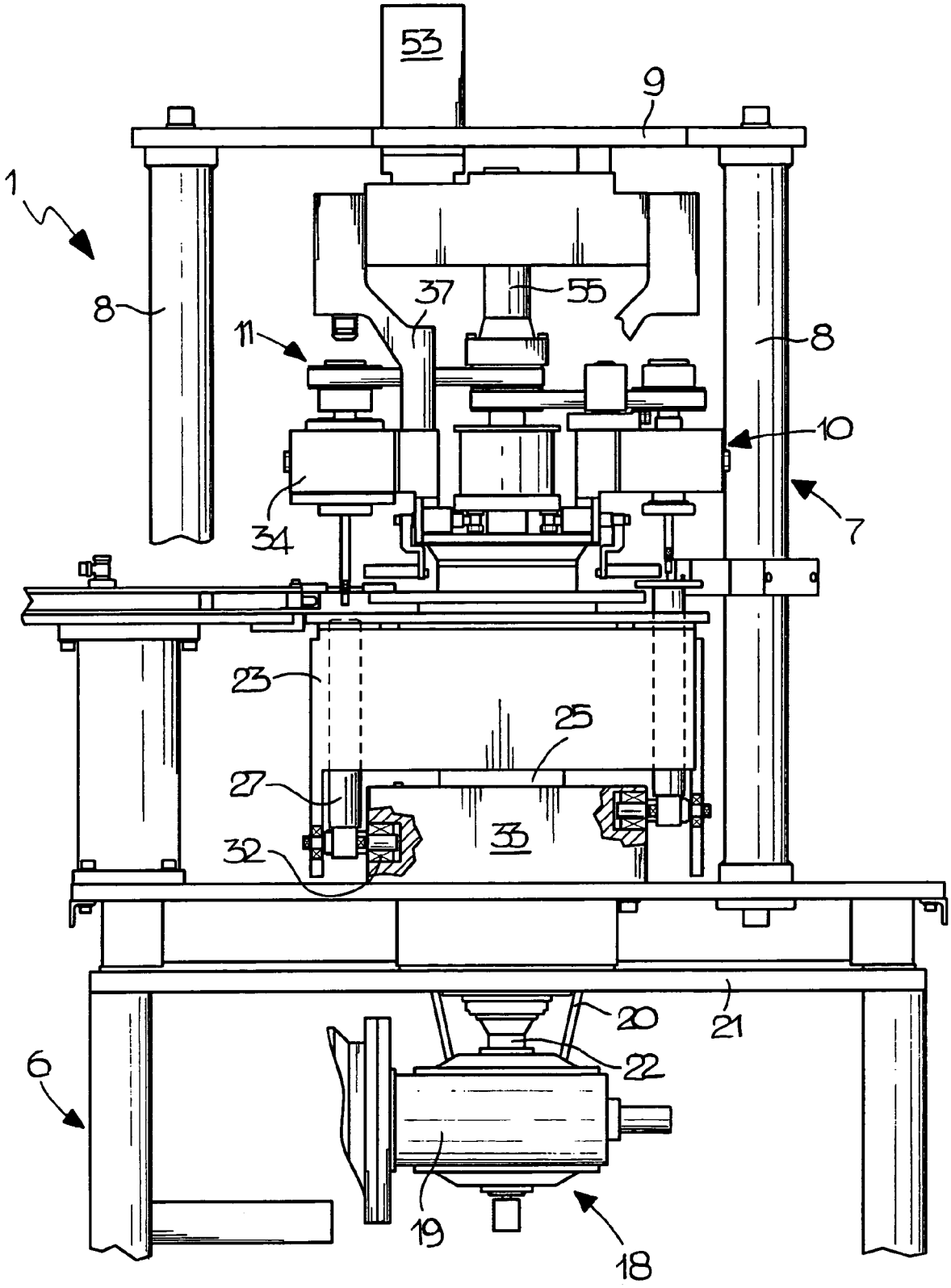
FIG. 1 is a front view of the apparatus according to the invention.

With particular reference to the cited figures, the reference numeral 1 generally designates an apparatus for making a fracture cut between the cup and the safety ring in plastic caps 2 according to the invention.

The apparatus, of the type suitable to make a fracture cut between the cup 3 and the safety ring 4 in caps 2 to be applied so as to close containers (the cup 3 being preferably provided with internal retention elements 5 for engagement on a collar provided on the respective container), comprises a footing 6, which protrudes upward with a substantially vertical frame 7 that is constituted by parallel uprights 8 that support a beam 9 (see FIG. 1).

Figure 4:
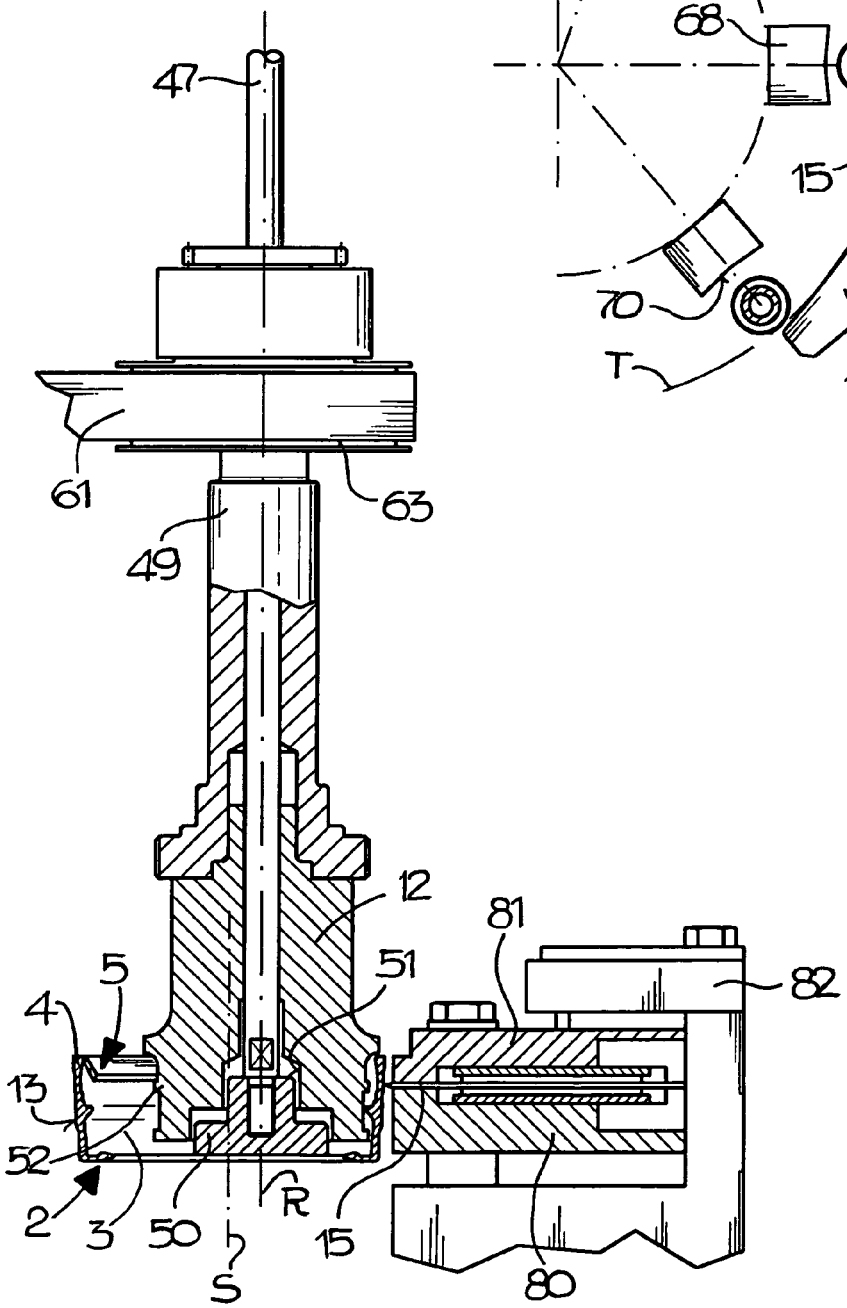
FIG. 4 is a partially sectional detailed side elevation view of the apparatus in the step for forming the fracture cut.

The footing 6 rotatably supports a rotary carousel 10, which has a vertical axis and is preset to convey continuously the caps 2 between input and output conveyance means, not shown in the figures. The footing 6 furthermore supports rotary means 11, which are provided with a plurality of mandrels 12 that have a vertical axis; each mandrel can be arranged inside a respective cup 3 and is suitable to roll, about the axis of symmetry S of the cap 2, the side wall 13 of said cups 3 along the cutting edge 14 of a blade 15, as shown in FIG. 4, for making the circumferential fracture cut on said side wall 13. For this purpose, the blade 15 is associated with an inlet path portion 16 for the cups 3, which is adjacent thereto and is suitable to axially offset each cup 3 with respect to the rotation axis R of the respective mandrel 12, 50 as to clamp the side wall 13 between said cutting edge 14 and the mandrel 12.

According to the invention, the apparatus comprises means 17 for recentering each cup 3 with respect to the rotation axis R of the respective mandrel 12 once the fracture cut has been made.

The carousel 10 is associated with means for continuous rotary actuation 18, which are constituted by a gearmotor 19 that is fixed by means of a flange 20 to parts 21 of the footing 6 and has a vertical output shaft 22 that is rigidly connected so that it is coaxial to said carousel 10.

Figure 2:
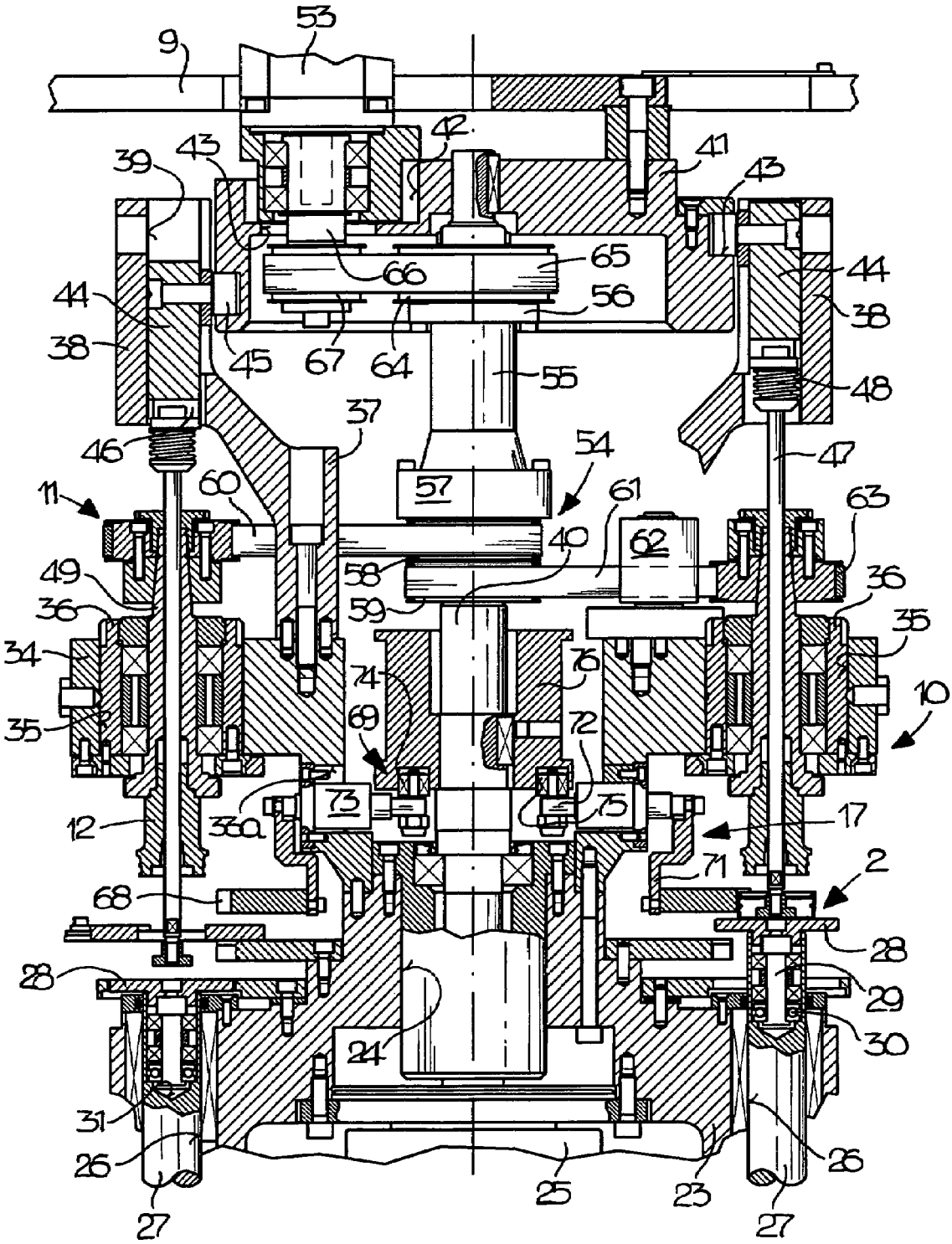
FIG. 2 is a partially sectional detailed front view of said apparatus.

The carousel 10 comprises (FIG. 2) a first drum 23, which is provided internally with an axial through cavity 24 and is connected in a downward region to a flanged shaft 25 that is connected to the output shaft 22 of the gearmotor 19 and is affected by multiple peripheral through holes 26 that have a vertical axis and are angularly equidistant for the sliding insertion of respective pillars 27 provided at their upper ends with seats for conveying the caps 2; the seats are preferably constituted by disk-like plates 28, which extend downward with respective stems 29 supported by thrust bearings 30 mounted within respective receptacles 31 provided in the pillars 27. The pillars 27 can be actuated so as to rise from a lower position to an upper position and have respective rollers 32 fixed to their respective lower ends, said rollers being engaged within an annular cam 33 that is coaxial to the shaft 25 and monolithic with the footing 6. Multiple lateral through slots 33*a* are further provided on the first drum 23 and are mutually angularly equidistant.

The first drum 23 is surmounted by a second drum 34, which is rigidly coupled thereto, is substantially annular and is provided with a plurality of cylindrical through seats 35 that have a vertical axis, each seat being coaxial to a respective through hole 26 of the first drum 23: a respective cylindrical bush 36 is locked in each seat 35.

A support 37 is rigidly fixed to the second drum 34 and is constituted by multiple peripheral arms 38, which are extended vertically and are mutually angularly equidistant: each one of the arms 38 is affected by a respective slot 39, which corresponds to a respective seat 35 of the second drum 34.

A vertical column 40, rigidly coupled to the footing 6, is inserted coaxially through the first and second drums 23 and 34; a substantially disk-like dome 41 is keyed to the top of the column 40 and is provided, in an upward region, with an opening 42 and has, on its lateral surface, a cylindrical cam 43 with a rolling track that has a rectangular transverse cross-section.

The rotary means 11 comprise a sliding block 44, which is provided with a lateral wheel 45 that engages in the cylindrical cam 43; the sliding block 44 is extended downward with a fixing bracket 46 for a rod 47, which is coupled elastically thereto with the interposition of a helical spring 48, which is inserted loosely in an elongated tubular body 49, which is supported so that it can rotate within the corresponding bush 36 and whose lower end ends with a substantially disk-like pad 50.

Each tubular body 49 has the respective mandrel 12 rigidly coupled thereto in a downward region; said mandrel is provided with an axial hole for the passage of the respective rod 47 and has, at its base, a cylindrical hollow 51 (FIG. 4); the mandrel 12 is preferably provided, on its lateral surface, with a distribution of collars 52 for the abutment of the retention elements 5 of the cup.

Advantageously, the rotary means 11 are actuated by a motor 53, for example of the brushless type and provided with a vertical axis, by way of belt drive elements 54.

The belt drive elements 54 comprise a sleeve 55, which is supported so that it can rotate along the column 40 and is actuated by the motor 53 at the respective upper end 56; a first toothed pulley 58 and a second toothed pulley 59 are keyed to said sleeve at its respective lower end 57, and a first toothed belt 60 and a second toothed belt 61 are wound around said first and second pulleys respectively, said belts being closed in a loop and being suitable for the rotary actuation of the mandrels 12: the first and second belts 60, 61 are wound, with the aid of suitable tensioning rollers 62, around respective driven pulleys 63, which are keyed to the top of the respective tubular bodies 49.

A third toothed pulley 64 is keyed at the upper end 56 of the sleeve 55, and a third toothed belt 65 is wound around said third pulley; said third belt is closed in a loop and is suitable for connection to the motor 53; a driving pulley 67 is keyed on the output shaft 66 of the motor 53, and the third toothed belt 65 is wound thereon. The output shaft 66 passes through the opening 42 of the dome 41, and its axis is parallel to the axis of the sleeve 55; as an alternative, it is noted that the motor 53 can be connected coaxially directly to the sleeve 55.

The recentering means 17 comprise multiple pushers 68, each of which acts on the side wall 13 of the respective cup 3 in a direction that is substantially radial and centrifugal with respect to the axis of the carousel 10. The pushers 68 can be actuated by way of respective cam means 69.

Each one of the pushers 68 is preferably substantially quadrangular, with a slightly convex surface 70 for contact with the respective cup 3 (FIG. 3); the pusher 68 is connected to an arm 71 that continues with a stem 72 that can slide, in a substantially radial direction with respect to the carousel 10, within a respective guiding block 73, which is inserted in a respective slot 33*a*. A wheel 74 provided with a vertical axis is supported so that it can rotate at right angles at the free end of each stem 72; the cam means 69 are constituted by a flat track 75, which is closed in a loop and is provided in the lower face of a bush 76 that is fixed coaxially to the carousel 10 along the column 40. The track 75 is suitable for the rolling of the wheels 74 having a vertical axis, causing the radial translational motion of the respective pushers 68 in order to move each cup 3 centrifugally, moving the axis of symmetry S of said cup 3 so that it coincides with the rotation axis R of the respective mandrel 12.

There is also a peripheral abutment element 77 for the cups 3 moved by the respective pushers 68, which comprises a supporting bracket 78 that has an elongated shape and ends with an L-shaped portion 79 that can be adjusted radially with respect to the carousel 10 according to the dimensions of the cups 3.

The blade 15 is packed between a lower reference plate 80 and an upper complementary plate 81, which is locked thereat by virtue of suitable fixing means 82 (for example of the clamp type): the cutting edge 14 has a profile that is shaped substantially like a circular arc that is concentric with respect to the rotational path T of each cup 3 on the carousel 10. The inlet portion 16 is formed on the plate 80 and the complementary plate 81 and is shaped so as to provide an axial offset of the cup 3 in its rolling motion with respect to the rotation axis R of the respective mandrel 12.

The operation of the apparatus according to the invention is as follows: each cap 2 is locked on the carousel 10 between the plate 28 and the pad 50, said pad 50 being actuated so as to descend by virtue of the rolling of the respective lateral wheel 45 in the cylindrical cam 43, the plate 28 being actuated so as to rise to the plane of the blade 15 by virtue of the rolling of the respective roller 32 along the annular cam 33; the presence of the helical spring 48 allows to compensate for even slight size differences among the various caps arising from any manufacturing imperfections.

The rolling of each cup 3 about its own axis of symmetry S, which is substantially parallel to the rotation axis R of the respective mandrel 12 after passing over the inlet portion 16, allows to make the fracture cut along the side wall 13, which is clamped between said mandrel 12 and the blade 15 (see FIG. 4).

Figure 3:
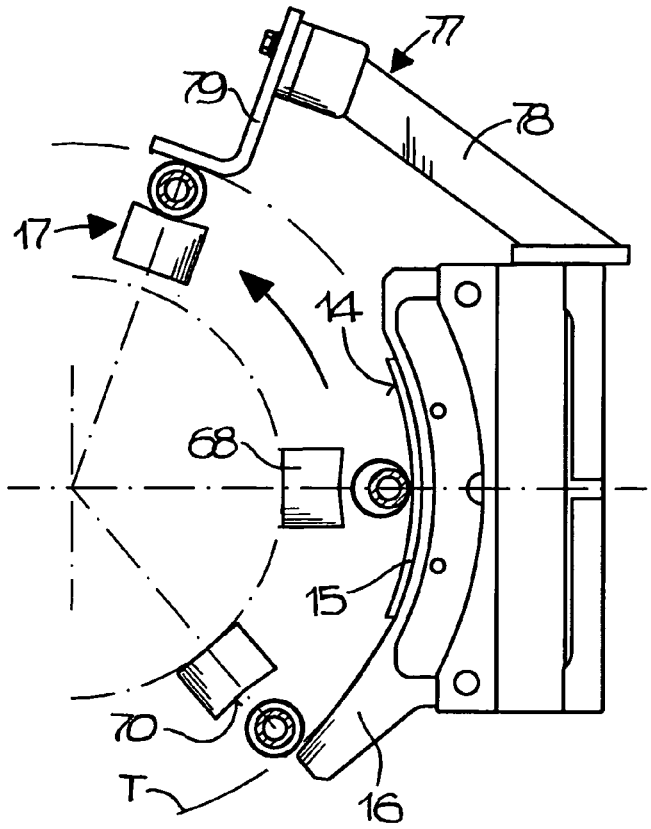
FIG. 3 is a detailed plan view of the apparatus in the step for forming the fracture cut.

At this point, the cam means 69 induce the centrifugal radial translational motion of the corresponding stem 72 and therefore of the pusher 68, which by acting on the side wall 13 of the cup 3 makes its axis of symmetry S coincide again with the rotation axis R of the respective mandrel 12; this occurs with the aid of the abutment element 77, which stops precisely the radial movement of the cup 3 (FIG. 3).

The apparatus according to the invention ensures, at the end of the provision of the fracture cut, an effective recentering of the cup 3 with respect to the rotation axis R of the mandrel 12; this operation, moreover, can be performed in a very versatile manner with caps 2 of various shapes and dimensions.

It has thus been shown that the invention achieves the proposed aim and objects.

The invention thus conceived is susceptible of numerous modifications and variations, all of which are within the scope of the inventive concept.

All the details may further be replaced with other technically equivalent ones.

In practice, the materials used, as well as the shapes and the dimensions, may be any according to requirements without thereby abandoning the scope of the protection of the appended claims The disclosures in Italian Patent Application no. BO2002A000422, from which this application claims priority, are incorporated herein by reference.

What is claimed is:

1. An apparatus for making a fracture cut in a plastic cap, the plastic cap having an axis of symmetry thereof and comprising a cup with a side wall and a safety ring, the fracture cut being made in the side wall of the cap between the cup and the safety ring, the apparatus comprising:

a footing and a frame;

rotary means supported on said footing and provided with at least one mandrel that has a rotation axis thereof and is arrangeable inside the cup of a cap;

a blade supported on said frame and arranged along a path of movement of the at least one mandrel for making said cut with a cutting edge thereof, a cap inlet path portion associated with said blade and including means to offset the axis of symmetry of the cap with respect to the rotation axis of said mandrel by clamping the cap side wall against said mandrel, said rotary means rotating the at least one mandrel as it moves along said blade to produce rolling of the clamped side wall about the axis of symmetry of the cap and along the cutting edge of said blade for making said cut; and recentering means comprising at least one pusher and a cam means supported at said frame, said cam means moving said at least one pusher toward said path of movement of the at least one mandrel to act on the cap side wall for recentering said cap so that the symmetry axis thereof coincides with said rotation axis of the mandrel.

2. The apparatus according to claim 1, wherein said cutting edge of said blade has a profile that is substantially shaped like a circular arc for being concentric with respect to a path of rotation of said cups, said inlet portion being formed by a plate and a complementary plate that support said blade.

3. The apparatus of claim 1, comprising a carousel supported on said footing and having a vertical axis thereof, said carousel being provided with said rotary means provided with a plurality of said mandrels and having a plurality of peripheral seats provided on a first drum thereof for conveying a plurality of caps between input and output conveyance means, said footing extending upward with said frame so that said frame surmounts said carousel.

4. The apparatus of claim 3, comprising a motor and belt drive elements that are supported on said frame and are suitable to actuate said rotary means provided with said plurality of mandrels.

5. The apparatus of claim 3, wherein said recentering means comprise a plurality of pushers, each for acting on the side wall of each one of the plurality of caps in a direction that is substantially radial and centrifugal with respect to said carousel, said plurality of pushers being actuated by said cam means.

6. The apparatus of claim 5, wherein each one of said pushers has a substantially quadrangular shape with a surface thereof for contact with the side walls of the cups that is convex, said pushers being each connected to an arm that extends with a stem, said stem being slidable substantially radially with respect to said carousel within a respective guiding block of said first drum, said stem being connected at a free end thereof to a respective wheel, said cam means comprising a track that is closed in a loop and is provided on a bush that is coaxial to said carousel and is monolithic with said footing, said track being suitable for the rolling of said wheel and having such a shape as to produce radial translational motion of said pushers.

7. The apparatus of claim 4, wherein said belt drive elements comprise: a sleeve, which is supported for rotation on a column that is coaxial to said carousel, is rigidly coupled to said footing and is actuated at a respective upper end by said motor; first and second coaxial toothed pulleys that are keyed at a respective lower end of said sleeve; first and second toothed belts wound respectively around said pulleys, said belts being closed in a loop and being suitable for the rotary actuation of a plurality of said mandrels that have vertical axes.

8. The apparatus of claim 7, wherein said motor is coaxially connected to said upper end of said sleeve.

9. The apparatus of claim 7, comprising a third toothed pulley keyed at said upper end of said sleeve, a respective third toothed belt being wound around said third pulley, said third belt being closed in a loop and suitable for connection to said motor whose axis is parallel to the axis of said sleeve.

10. An apparatus for making a fracture cut in a plastic cap, the plastic cap having an axis of symmetry thereof and comprising a cup with a side wall and a safety ring, the fracture cut being made in the side wall of the cap between the cup and the safety ring, the apparatus comprising:

a footing and a frame;

a carousel supported on said footing having a plurality of peripheral seats provided on a first drum thereof for conveying a plurality of caps between input and output conveyance means;

rotary means supported on said footing and provided with a plurality of mandrels that have respective rotation axes thereof, each said mandrel being arrangeable inside a respective cup of a cap;

a blade supported on said frame for making said cut with a cutting edge thereof;

a cap inlet path portion associated with said blade so as to offset the axis of symmetry of the cap with respect to the rotation axis of the mandrel thereinside by clamping the cap side wall against said mandrel;

said rotary means being suitable for rotary actuation of the mandrels located inside the cup of the cap to produce rolling of the clamped side wall about the axis of symmetry of the cap and along the cutting edge of said blade for making said cut; and recentering means comprising a plurality of pushers and cam means supported at said frame, said cam means being suitable to cause motion of said pushers to act on the side wall of each one of the plurality of caps in a direction that is substantially radial and centrifugal with respect to said carousel for recentering each cap so that the symmetry axis thereof coincide with the rotation axis of the mandrel located thereinside.

* * * * *